United States Patent [19]

Natsuhara et al.

[11] Patent Number: 4,728,859

[45] Date of Patent: Mar. 1, 1988

[54] IN-LINE ELECTRON GUN

[75] Inventors: Masao Natsuhara, Otsu; Hiroshi Suzuki, Nagaokakyo; Hideo Muranishi, Osaka; Shigeya Ashizaki, Takatsuki, all of Japan

[73] Assignee: Matsushita Electronics Corporation, Kadoma, Japan

[21] Appl. No.: 904,270

[22] Filed: Sep. 8, 1986

[30] Foreign Application Priority Data

Sep. 9, 1985 [JP] Japan ..... 60-198830

[51] Int. Cl.[4] ..... H01J 29/56; H01J 29/50

[52] U.S. Cl. ..... 315/15; 313/414

[58] Field of Search ..... 315/14, 15, 16; 313/414

[56] References Cited

U.S. PATENT DOCUMENTS 4,275,332 6/1981 Ashizaki et al. ..... 313/414

4,612,474 9/1986 Ashizaki et al. ..... 313/414

FOREIGN PATENT DOCUMENTS 58-192252 9/1983 Japan .

0197639 11/1983 Japan ..... 313/414

59-051440 3/1984 Japan .

*Primary Examiner*—Theodore M. Blum

*Assistant Examiner*—Gregory C. Issing

*Attorney, Agent, or Firm*—Cushman, Darby & Cushman

[57] ABSTRACT

In an in-line electron gun for a color picture tube, 10*c* aligned with three cathodes 10*a*, 10*b* and 10*c*, through-holes of a control grid 11 and an accelerating electrode 12 are spaced by a distance $S_1$; distance $S_2$ between inlet through-holes 13*a*, 13*b* and 13*c* of a first focusing electrode 13 are spaced by a distance $S_3$; outlet through-holes 13*d*, 13*e* and 13*f* of the first focusing electrode 13 and inlet through-holes 14*a*, 14*b* and 14*c* of a second focusing electrode 14 are spaced by a distance $S_3$; outlet through-holes 14*d*, 14*e* and 14*f* of the second focusing electrode 14 and of an anode, 15 are spaced by a distance $S_4$. The distances are selected to have a relation of $S_4 < S_3 < S_1 < S_2$, enabling misconvergence to be minimized.

7 Claims, 7 Drawing Figures

IN-LINE ELECTRON GUN

FIELD OF THE INVENTION AND RELATED ART STATEMENT

1. Field of the Invention

The present invention relates to an in-line electron gun adapted to be incorporated into a color picture tube.

2. Description of the Related Art

Picture quality of a color picture reconstructed on a color picture tube depends on a resolution characteristic and a convergence characteristic of the color picture tube. In order to provide a good resolution characteristic, beam spots of small diameter and of nearly circular shape must be produced on not only the center part but also the circumference parts of a phosphor screen.

On the other hand, in driving a color picture tube having an in-line electron gun, a horizontal deflection field having a pincushion shaped distribution and a vertical deflection field having a barrel shaped distribution are generated by a deflection yoke, and a self-convergence effect is obtained as a result. Beam spots formed by electron beams passing through such distorted vertical and horizontal deflection fields are heavily distorted on the circumference parts of the phosphor screen. Namely, the beam spot formed on the center of the phosphor screen is circular, whereas the beam spots formed on the circumference parts of the phosphor screen are horizontally oblong ellipses 3 with vertically large hazes 3*a*, which are shown in FIG. 2.

In a color picture tube shown in Japanese published unexamined patent application Sho No. 58-192252, electron beams are impressed with a non-rotational symmetry dynamic additional focusing electrical field in order to reduce the above-mentioned distortion in beam spots. As shown in FIG. 1, the color picture tube in this device has cathodes 4, a control grid electrode 5, an accelerating electrode 6, a first focusing electrode 7, a second focusing electrode 8 and an anode 9. At least one group of through-holes through which the electron beams pass and which are disposed on facing surfaces of the first focusing electrode 7 and the second focusing electrode 8 are formed by non-rotational symmetry. A fixed focusing potential $V_f$ is applied to one of the first and second focusing electrodes 7 and 8, and a dynamic potential which gradually increases or decreases from the potential $V_f$ in proportion to the increase of the deflection angle of the electron beam, is applied to the other.

By constituting an inline electron gun as mentioned above, the aberration due to the deflection of the electron beam can be reduced and almost circular beam spots are formed even on the circumference parts of the phosphor screen however, the application of the dynamic potential may cause discordance in the convergence of the three electron beams. If the above-mentioned non-rotation symmetry dynamic additional focusing electric field is adapted to another color picture tube shown in Japanese published unexamined patent application Sho No. 59-51440, where side through-holes of a focusing electrode through which electron beams pass are deflected outward in comparison with those of a control electrode and of an accelerating electrode in order to produce static convergence, then the magnification of a main lens of the above-mentioned color picture tube varies, and also an equivalent electron source moves. As the result, further misconvergence occurs.

OBJECT AND SUMMARY OF THE INVENTION

The purpose of the present invention is to prepare an in-line electron gun in which good resolution and convergence can be obtained in the entire region of a phosphor screen and which can be adapted for use with the static convergence constitution as shown in Japanese published unexamined patent application Sho No. 59-51440.

An in-line electron gun in accordance with the present invention comprises:

a group of horizontally in-lined cathodes, a control grid electrode, an accelerating electrode, a first focusing electrode, a second focusing electrode, and an anode which are respectively in-lined along the axis of the electron gun, wherein:

the cathodes are in-lined with a first distance $S_1$ between each respective electron gun beam axis, the control grid electrode and the accelerating electrode have plural through-holes respectively in-lined at the first distance $S_1$, each respective electron gun beam axis being in-lined with respective through-holes on the control grid electrode and the accelerating electrode, the first focusing electrode has, on a surface facing the accelerating electrode, plural through-holes in-lined at a second distance $S_2$ which is larger than the first distance $S_1$, one of the surfaces of the first focusing electrode faces one of the surfaces of the second focusing electrode, each surface having plural vertically oblong through-holes in-lined at a third distance $S_3$ which is smaller than the first distance $S_1$, the other facing surface of one of the first focusing electrode and the second focusing electrode has one or more horizontally oblong through-holes, centers thereof being coincident with those of the vertically oblong through-holes, the second focusing electrode also has a surface facing the anode containing a plurality of through-holes horizontally in-lined at a fourth distance $S_4$ which is smaller than the third distance $S_3$, the anode has a surface facing the second focusing electrode containing a plurality of through-holes horizontally in-lined at the fourth distance $S_4$, and the first focusing electrode receives a fixed focusing potential and the second focusing electrode receives a dynamic potential which changes to a potential higher or lower than the fixed focusing potential in response to an increase of the electron beam deflection angle.

DESCRIPTION OF THE PREFERRED EMBODIMENT

Figure 1:
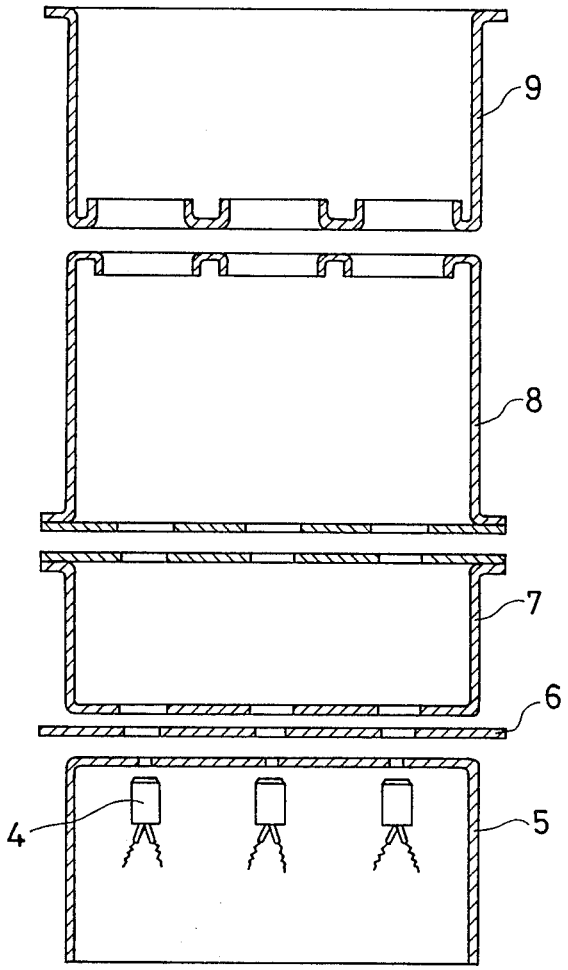
FIG.1 (Prior Art)
FIG. 1 is the cross-sectional side view showing the electron gun of the conventional color picture tube.
Figure 2:
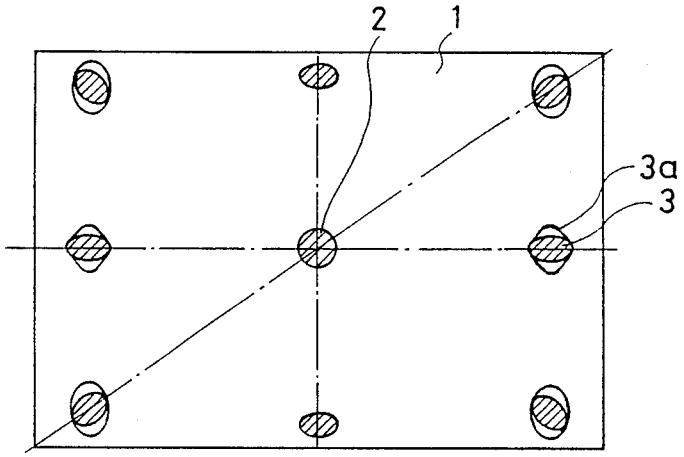
FIG. 2 (Prior Art)
FIG. 2 is the schematical view showing the shape of distortions of the beam spots at various positions on the phosphor screen.
Figure 3:
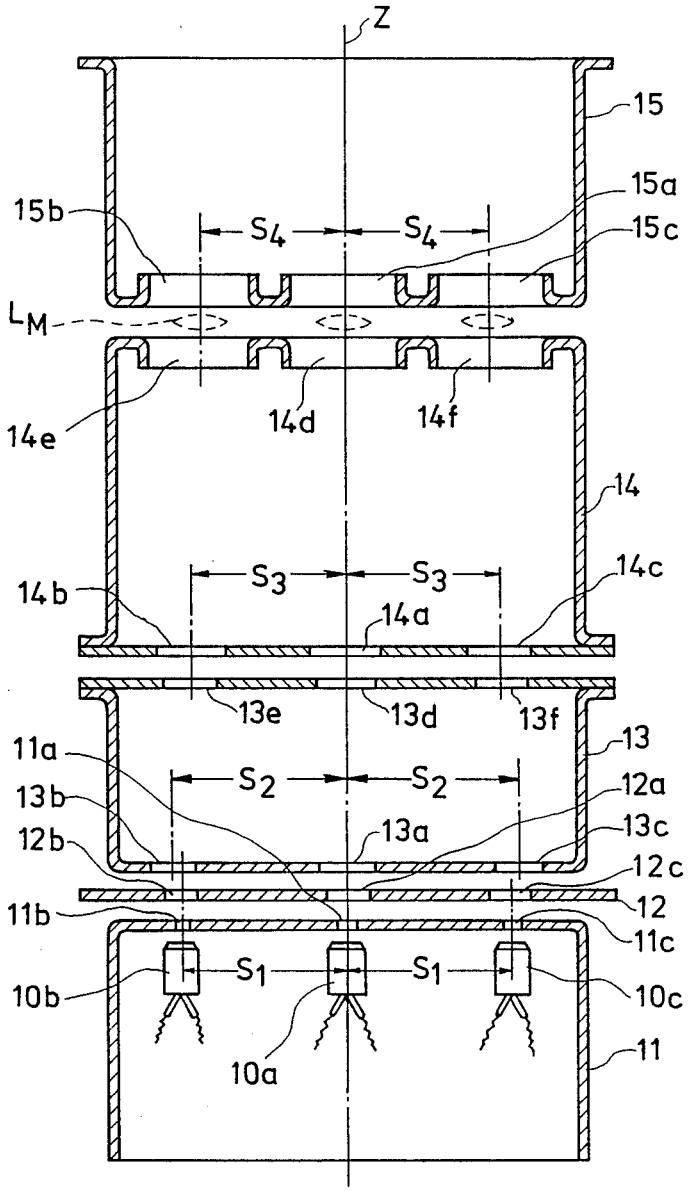
FIG. 3 is a cross-sectional side view showing an electron gun of a color picture tube in accordance with the present invention.

A preferred embodiment of an in-line electron gun in accordance with the present invention is described with reference to FIG. 3. The in-line electron gun comprises three cathodes 10*a*, 10*b* and 10*c* which are disposed horizontally in a line, a control grid electrode 11, an accelerating grid 12, a first focusing electrode 13, a second focusing electrode 14 and an anode 15. These elements are respectively disposed along an axis Z of the electron gun. The control grid electrode 11 has a circular center through-hole 11*a* and two circular side through-holes 11*b* and 11*c* through which electron beams pass, and the accelerating electrode 12 also has a circular center through-hole 12*a* and two circular side through-holes 12*b* and 12*c* through which the electron beams pass. The center axes of the center through-holes 11*a* and 12*a* are coincident with the axis Z of the electron gun, and center axes of the side through-holes 11*b*, 11*c*, 12*b* and 12*c* are respectively apart by the distance $S_1$ from the axis Z of the electron gun.

Figure 4:
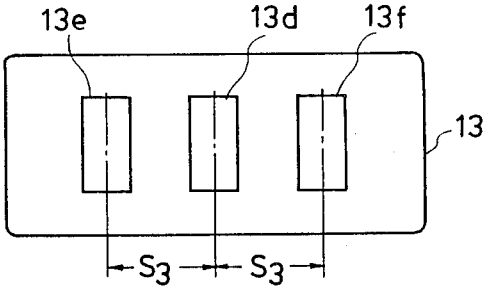
FIG. 4 and FIG. 5 are respective front views showing through-holes of focusing electrodes in accordance with the present invention through which electron beams pass.
Figure 5:
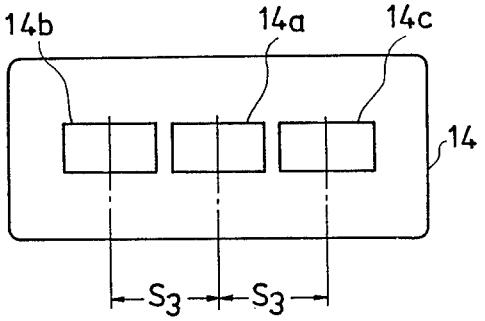

The first focusing electrode 13 has a circular center through-hole 13*a* and two circular side through-holes 13*b* and 13*c* on a surface which faces the accelerating electrode 12, and it also has a vertically oblong center through-hole 13*d* and two vertically oblong side through-holes 13*e* and 13*f* on the other surface which faces the second focusing electrode 14. The vertically oblong through-holes 13*d*, 13*e* and 13*f* are shown in FIG. 4 in detail. Center axes of the center through-holes 13*a* and 13*d* are respectively coincident with the axis Z of the electron gun. Center axes of the circular side through-holes 13*b* and 13*c* are apart by a distance $S_2$ from the axis Z of the electron gun, whereas those of the vertically oblong side though-holes 13*e* and 13*f* are apart by a distance $S_3$ from the axis Z of the electron gun. The second focusing electrode 14, on the other hand, has a horizontally oblong center through-hole 14*a* and two horizontally oblong side through-holes 14*b* and 14*c* on a surface facing the first focusing electrode 13. Second focusing electrode 14 also has a circular center through-hole 14*d* and two circular side through-holes 14*e* and 14*f* on the other surface facing the anode. The horizontally oblong through-holes 14*a*, 14*b* and 14*c* are shown in FIG. 5 in detail. Center axes of the center through-holes 14*a* and 14*d* are respectively coincident with the axis Z of the electron gun, center axes of the horizontally oblong side through-holes 14*b* and 14*c* are apart by the distance $S_3$ from the axis Z, and center axes of the circular side through-holes 14*e* and 14*f* are apart by a distance $S_4$ from the axis Z.

The anode 15 also has a center circular through-hole 15*a* and two circular side through-holes 15*b* and 15*c*. The center axis of the center through-hole 15*a* is coincident with the axis Z, and the center axes of the side through-holes 15*b* and 15*c* are respectively apart by the distance $S_4$ from the axis Z. When the electron gun is active, three main lenses $L_M$ are generated between the through-holes 14*d*, 14*e* and 14*f* of the second focusing electrode and the through-holes 15*a*, 15*b* and 15*c* of the anode 15.

Typical DC (direct current) potentials applied to the respective electrodes in an active state are as follows:

Cathode: 50–150 V
Control grid electrode: 0 V
Accelerating electrode: 300–500 V
First focusing electrode: 6–8 KV
Second focusing electrode: dynamic potential
Anode: about 25 KV, and the dynamic potential is varied synchronously with the horizontal deflection of the electron beams. Namely, when the horizontal deflection angle of the electron beams is zero, the second focusing electrode 14 receives a potential of 6–8 KV which is nearly equal to the potential of the first focusing electrode 13, and the dynamic potential gradually increases in response to the increase of the horizontal deflection angle of the electron beams. When the horizontal deflection angle of the electron beams is a maximum, the potential of the second focusing electrode 14 is about 0.2–0.5 KV higher than the potential of the first focusing electrode 13.

Figure 6:
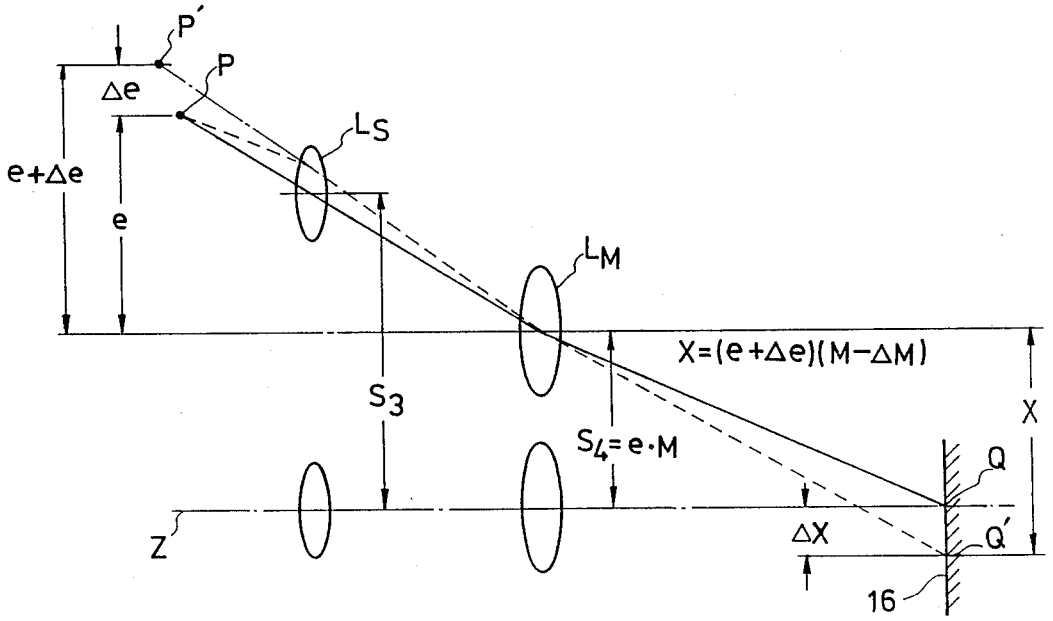
FIG. 6 is a schematic view showing misconvergence occurring when the potential of the second focusing electrode is higher than the potential of the first focusing electrode.

The misconvergence which occurs when the potential of the second focusing electrode is higher than that of the first focusing electrode is described with reference to FIG. 6. The distance $S_4$ is set to be e·M ($S_4$=e·M) when the magnification of the main lens $L_M$ is M and the distance between the equivalent electron source P for a side electron beam and the axis of the main lens $L_M$ for the side electron beam is e. When an additional lens $L_S$ is not formed by the first focusing electrode 13 and the second focusing electrode 14, namely, when the horizontal deflection angle of the electron beam is zero, the convergence of the three electron beams is kept. On the other hand, when the horizontal deflection angle of the electron beams increases and the additional lens $L_S$ is formed between the main lens $L_M$ and the equivalent electron source P, another equivalent electron source P′ is formed by the additional lens Ls, and at the same time, the magnification of the main lens $L_M$ changes from M to M−ΔM. As a result, the arrival point of the side electron beam moves from point Q to point Q′, which is at the distance ΔX from Q. Thus, the misconvergence occurs on the circumference parts of the phosphor screen.

The distance X between the center axis of the main lens $L_M$ for the side electron beam and point Q′ is given as:

$$X = (e + \Delta e)(M - \Delta M) \quad (1)$$
$$= e \cdot M - e \cdot \Delta M + \Delta e \cdot M - \Delta e\, \Delta M.$$

Then the distance ΔX, namely, the amount of misconvergence is approximated as $$\Delta X = \Delta e \cdot M - e \cdot \Delta M \quad (2),$$

where Δe, ΔM, e and M are respectively positive values. In case of ΔX>0, the side electron beam is over-converged with the center electron beam, and in case of ΔX<0, the side electron beam is under-converged.

In order to avoid such misconvergence, the absolute value of ΔX needs to be as small as possible, which is realized by setting the distances as a relation, $S_4 < S_3 < S_1$. The validity of this relation can be confirmed in the following fashion. When the distance $S_3$ between the center axis of the additional lens $L_S$ for the side electron beam and the axis Z is set nearly equal to the distance between the equivalent electron source P and the axis Z, the distance $\Delta e$ is nearly equal to zero. As the equivalent electron source P is generated nearly on the common axis of the through-holes of the control electrode 11 and the accelerating electrode 12, the distance between the equivalent electron source P and the axis Z is nearly equal to the distance $S_1$, which is the distance between the centers of the side through-holes 11*b*, 11*c* of the control grid electrode 11 or 12*b*, 12*c* of the accelerating electrode 12. When $\Delta e=0$, the distance $\Delta X$ is given as $\Delta X=-e\cdot\Delta M$ from the expression (2), so the misconvergence occurs. The absolute value of the misconvergence is about 0.5 mm. Therefore, the distance $S_3$ should be smaller than distance $S_1$ ($S_3<S_1$).

Further, when the distance of the additional lens $L_s$ from the axis Z is set nearly equal to the distance $S_4$ of the main lens $L_M$ for the side electron beam from the axis Z, the distance $\Delta e$ becomes excessively large. The large distance between the axis of the additional lens $L_S$ and the equivalent electron source P is magnified by the lens $L_S$, thereby causing an excessive shift of the equivalent electron source P'. As a result, a misconvergence in which the absolute value of $\Delta X$ is about 0.5 mm occurs. Therefore, the distance $S_3$ should be larger than the distance $S_4$ ($S_3>S_4$)

According to the present invention, the occurrence of the misconvergence is prevented by setting the relation of the distances as $S_4<S_3<S_1$ so that $\Delta X$ is set nearly equal to zero. Also, in the present invention, in order to incline the side electron beams for making static convergence, the side through-holes 13*b* and 13*c* on the surface of the first focusing electrode 13 facing to the accelerating electrode 12 are disposed outward from the axis Z of the electron gun, in comparison with the side through-holes 11*b*, 11*c*, 12*b* and 12*c* on the control grid electrode 11 and the accelerating electrode 12. Namely the relation of the distances $S_1$ and $S_2$ is set as $S_1<S_2$.

The most preferrable concrete values for use when the present invention is embodied in a 20 inch size (diagonal of the phosphor screen) and 90 degree deflection type color picture tube, are shown as follows. The diameter of each circular through-hole of the control grid electrode is 0.4 mm; the diameter of each circular through-hole of the accelerating electrode is 0.4 mm; the distance $S_1$ is 6.1 mm; the length of the first focusing electrode in the axial direction of the electron gun is 7.5 mm; the diameter of each circular through-hole of the first focusing electrode on the surface opposing the accelerating electrode is 1.5 mm; the distance $S_2$ is 6.2 mm; the distance between the accelerating electrode and the first focusing electrode in the axial direction of the electron gun is 1.0 mm; each vertically oblong through-hole of the first focusing electrode on the surface facing the second focusing electrode has a width of 2.2 mm and a length of 4.95 mm; the distance $S_3$ is 5.9 mm; the length of the second focusing electrode in the axial direction of the electron gun is 16.7 mm; each horizontally oblong through-hole of the second focusing electrode on the surface facing the first focusing electrode has a width of 4.95 mm and a length of 2.2 mm; the diameter of each circular through-hole of the second focusing electrode on the surface facing the anode is 4.5 mm; the distance $S_4$ is 5.5 mm; the diameter of each circular through-hole of the anode is 4.5 mm; the distance between the second focusing electrode and the anode is 1.0 mm; the dynamic potential has a minimum value of 8.0 KV and a maximum value of 8.4 KV (or when the minimum value is 6.0 KV the maximum value is 6.3 KV).

Figure 7:
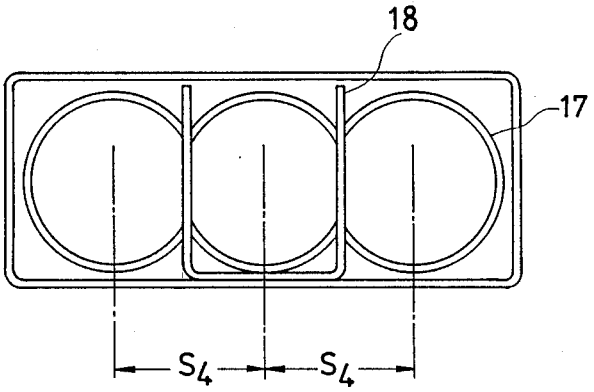
FIG. 7 is a front view showing through-holes through which electron beams of main lenses pass.

In the above-mentioned embodiment, the horizontal oblong through-holes of the second focusing electrode 14 on the surface facing the first focusing electrode 13 are provided as a set of three through-holes. However, one wide horizontal oblong through-hole without vertical partitions is usable. Also the through-holes 14*d*, 14*e* and 14*f* of the second focusing electrode 14 and the through-holes 15*a*, 15*b* and 15*c* of the anode 15, which face the respective counterparts for generating the main lens, can be made continuous into one through-hole 17 as shown in FIG. 7. In this case, however, as shown in Japanese patent Sho No. 58-20093, an electrode 18 for compensating the electric field must be disposed in order to form the three main lenses. Hereupon, the distance $S_4$ should be the distance between the center of the equivalent main lens for a side electron beam and the center axis of the electron gun.

We claim:

1. An in-line electron gun comprising:

a plurality of cathodes disposed parallel to each other, adjacent electron guns having beam axes separated by a first distance $S_1$;

a control grid electrode having a plurality of through-holes, the centers of which are separated by said first distance $S_1$;

an accelerating electrode having a plurality of through-holes, the centers of which are separated by said first distance $S_1$, each respective electron gun beam axis being concentric with corresponding respective through-holes of the control grid electrode and the accelerating electrode;

a first focusing electrode having a surface facing the accelerating electrode containing a plurality of through-holes, the centers of which are separated by a second distance $S_2$ greater than said distance $S_1$, another surface of said first focusing electrode, opposite the surface facing the accelerating electrode, having a plurality of vertically oblong through-holes, the centers of which are separated by a third distance $S_3$, which is less than said distance $S_1$;

a second focusing electrode having a surface facing the first focusing electrode with one or more horizontally oblong through-holes, respective centers of which are coincident with respective centers of the vertically oblong through-holes of said first focusing electrode, another surface of said second focusing electrode, opposite the surface facing the first focusing electrode, having a plurality of through-holes, the centers of which are separated by a fourth distance $S_4$, which is less than said third distance $S_3$; and an anode having a surface facing the second focusing electrode with a plurality of through-holes, the centers of which are separated by said fourth distance $S_4$ and concentric with the corresponding respective through-holes of said second focusing electrode separated by the distance $S_4$, wherein:

said first focusing electrode receives a fixed focusing potential and said second focusing electrode receives a dynamic potential which changes to a potential higher or lower than the fixed focusing potential in response to an increase of the electron beam deflection angle.

2. An in-line electron gun in accordance with claim 1, wherein said second focusing electrode has only one horizontally oblong through-hole which is separated into a plurality of through-holes by at least one bridging member.

3. An in-line electron gun in accordance with claim 1, wherein the concentric through-holes of said second focusing electrode and said anode form main lenses for each respective beam of said respective electron guns.

4. An in-line electron gun in accordance with claim 1, wherein said dynamic potential changes synchronously with respect to the horizontal deflection of electron beams outputted by said cathodes.

5. An in-line electron gun in accordance with claim 4, wherein said dynamic potential is substantially equal to the potential of said first focusing electrode when the electron beam deflection angle is zero.

6. An in-line electron gun in accordance with claim 4, wherein said dynamic potential is 0.2 to 0.5 KV higher than said fixed focusing potential of said first focusing electrode when the horizontal deflection of the electron beam is a maximum.

7. An in-line electron in accordance with claim 1, wherein said dynamic potential equals said fixed focusing potential when the electron beam deflection angle is zero, said dynamic potential changing to a higher value than said fixed focusing potential as said electron beam deflection angle increases.

* * * * *